United States Patent [19]

Scott

[11] Patent Number: 4,858,444

[45] Date of Patent: Aug. 22, 1989

[54] PORTABLE COOLER

[76] Inventor: Jeff Scott, 11531 NW. 23rd St., Pembroke Pines, Fla. 33026

[21] Appl. No.: 272,920

[22] Filed: Nov. 18, 1988

[51] Int. Cl.[4] ..... F25D 3/08

[52] U.S. Cl. ..... 62/372; 62/457.5; 62/459; 62/464

[58] Field of Search ..... 62/457, 459, 464, 372

[56] References Cited

U.S. PATENT DOCUMENTS

| | | | |
|---|---|---|---|
| 2,289,254 | 7/1942 | Eagles | 62/457 X |
| 4,196,817 | 4/1980 | Moser | 62/372 X |
| 4,211,091 | 7/1980 | Campbell | 62/372 |
| 4,343,158 | 8/1982 | Campbell | 62/372 |
| 4,468,933 | 9/1984 | Christopher | 62/464 X |

*Primary Examiner*—Lloyd L. King
*Attorney, Agent, or Firm*—John-Paul J. Violette

[57] ABSTRACT

An improved portable cooler for carrying and cooling a 15-pak of beverages including a sealable cavity for pyramid-stacked containment of 12 or 16 oz. canned beverages, a plastic insert for retaining the lower layers of cans in side-by-side relation and supporting stacking of subsequent layers of cans upward, and dual storage spaces for ice about said beverage cans. The exterior of the portable cooler further includes such features as a flap with a velcro fastener for closing said sealable cavity, multiple pockets for paraphernalia, and a carrying strap.

12 Claims, 1 Drawing Sheet

PORTABLE COOLER

BACKGROUND OF THE INVENTION

1. Field of the Invention

This invention relates to a device for carrying and chilling cold beverages; and more particularly to a portable cooler with a plastic insert for stacked packing of beverage cans and a re-fillable cooling compartment for a coolant such as ice to be maintained about a chilled beverage.

2. Description of the Prior Art

Previously, there have been a number of carrying bags for carrying and chilling beverages that have been developed. Those carrying bags have included sealed compartments maintaining a chilled substance for cooling a beverage.

In some of those cases, the portable cooler has included a re-fillable compartment for adding or removing a coolant, such as water or ice. However, in those cases, the design has necessitated greater structure with limited portability or greater portability accompanied by more limited space for containers.

While the aforementioned devices are in common usage, it has also been recognized that in certain instances, such as at football games, maintaining chilled containers is limited by space as well as by mobility considerations.

Accordingly, in order to overcome the above set forth problem of space and portability, there is a need for a simplified device which is structured to be versatile in its operation to the extent of being capable of holding beverage containers in stacked relation with a minimum of structural components, maintaining coolant about the top and bottom of said containers continuously, and having carrying strap and flap designed for access to said containers while being conveyed or resting.

SUMMARY OF THE INVENTION

The present invention is directed to an improved portable cooler for carrying beverage containers specifically designed to maximize the quantity of beverage cans while minimizing the structure to be used in confining said cans in combination with conventional coolants, such as ice. In operation, the improved portable cooler of the present invention is structured to permit ready access to a chilled compartment for filling or removing beverage cans and ice; easy portability as under the arm of a user; ready access to the cans for consumption while being transported or stationary; easy access to each of the respective areas of the portable cooler for sanitary cleansing; and, easy storage by folding when not in use. The subject portable cooler enables easy & quick preparation for usage and is inexpensive in design.

Accordingly, it is the principal object of this invention to provide an improved portable cooler that has a minimum of structure and maximum capacity; that is re-usable and includes re-fillable, washable beverage can and coolant cavity an easily such that a user may simply deposit beverage cans in stacked arrangement and crushed ice in the coolant cavity, and seal and open the coolant cavity as needed to obtain a beverage; and, that provides ready access to beverages while being transported or stationary.

BRIEF DESCRIPTION OF THE DRAWINGS

For a fuller understanding of the nature of the present invention, reference should be had to the following detailed description taken in connections with the accompanying drawings in which.

Like reference numerals refer to like parts throughout the several views of the drawings.

DETAILED DESCRIPTION OF THE PREFERRED EMBODIMENT

Figure 1:
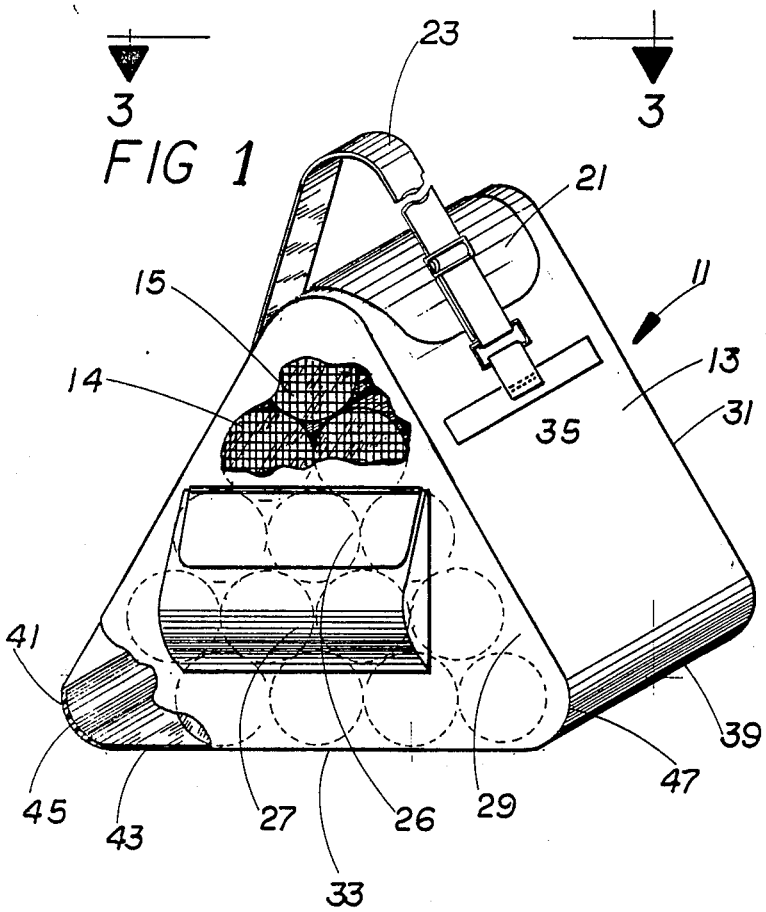
FIG. 1 is a side perspective view of the preferred embodiment of the improved portable cooler of the present invention wherein the coolant cavity containing beverage cans and ice is shown through a partial cutaway and by dotted lines.
Figure 3:
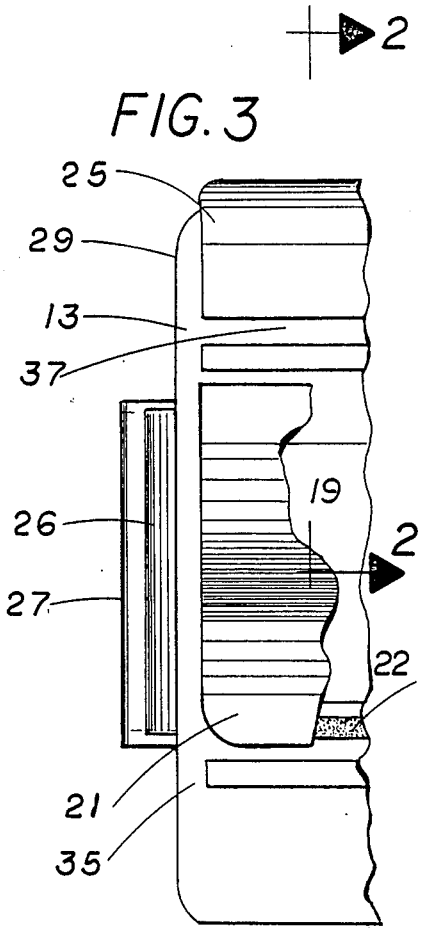
FIG. 3 is a cutaway-overhead view of the preferred embodiment wherein the lid is shown in partial cutaway in relation to velcro fastening means.
Figure 4:
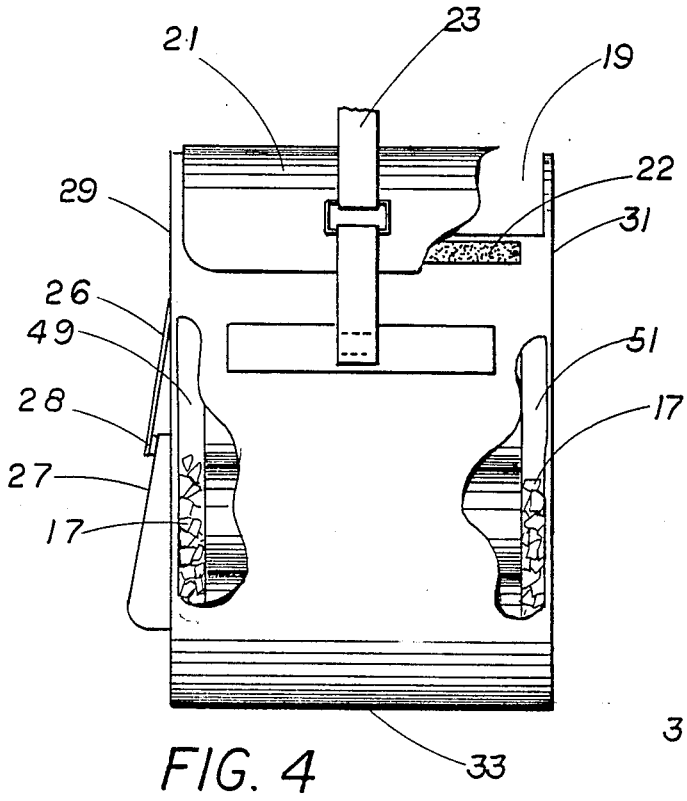
FIG. 4 is a front view of the preferred embodiment showing the lid and receptacle in partial cutaway.
Figure 2:
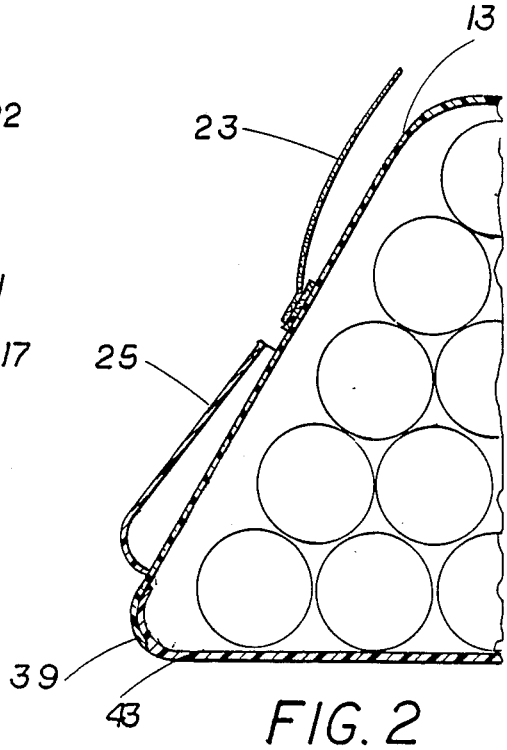
FIG. 2 is a cutaway-side view of the preferred embodiment of the improved portable cooler wherein the coolant cavity containing beverage cans and ice.

Referring to FIGS. 1 through 4, the present invention is directed towards an improved portable cooler generally indicates as 11 comprising a receptacle 13 sized and proportion provide a sealable cavity 14 for storing a fifteen-pak of beverage cans 15, such as twelve or sixteen ounce sized cans, or their sides in pyramid fashion and for storing ice 17 alongside the top and bottom of said cans 15; a mouth proportioned so that cans 15 may be easily inserted and removed through the top of the receptacle 13; a lid 21 sized to open and close over the mouth 19; an adjustable shoulder strap 23 fixed to the receptacle 13; and, multi-purpose exterior pockets 25 and 27. The cooler 11 being sized and proportioned for easy transporting as by looping the shoulder strap over the shoulder and carrying the cooler portion under the arm of a user; and, being further designed for easy access to beverages and stored paraphernalia while a user is either walking, standing, or sitting.

The improved portable cooler 11 is preferably made of a light-weight, insulating, waterproof material, such as a soft neoprene, for maintaining beverages, either cool or warm. The construction material further facilitates storage in small spaces when the cooler 11 is not in use; has a non-slipping surface; and, is soft and buffered for insulating a user against banging from the cans and ice. The design and sizing of said cooler makes for easy carrying snugly under the arm of a user.

The receptacle 13 has triangular-shaped sides 29 and 31, a base 33, a front width portion 35, and a rear width portion 37. A forward portion 39 of the base 33 joining the front width portion 35, and, a rearward portion 41 of the base 33 joining the rear width portion 37. The height of said receptacle 13 sized and proportioned to accommodate the height of five layers of side-stacked beverage cans 15, the base 33 having a length corresponding to the width of five cans 15 side-by-side, and the width portions 35 and 37 having widths sized and proportioned to provide for the length of the cans 15 plus dual storage spaces 49 and 51 for ice to be situated adjacent the top and bottom of said beverage cans 15 (space is shown between cans and front and rear width portions for pictorial clarity, where in fact the cans 15 are to abut those portions in order to maintain pyramid stacked positions).

The lid 21 is sized and proportioned to fit over the mouth 19 of the cooler 11. The lid 21 is sown on one side and fastened by Velcro fasteners 22 on the opposite side, where Velcro hook material is sown onto the inner side of the lid 21 and Velcro loop material is sown onto the corresponding side of the receptacle 13 adjacent the mouth 19. Preferably, the cooler 11 is carried by a user with the Velcro fastened side of the lid 21 facing forward under the arm for easy opening and access to the contents while walking or sitting, if necessary. The mouth 19 having been sized and proportioned to permit the easy entrance and egress of the hand and arm of a user with standard-sized 12 or 16 ounce containers, and being further sized to permit slabbed, cubed, or crushed ice to be inserted along the interior of the sides 29 and 31 of the receptacle 13. In an alternate embodiment, webbing may be sown along said interior of the sides 29 and 31 with an opening towards the mouth 19 for easy insertion of either slabbed, cubed, or crushed ice. Cubed or crushed ice may additionally or alternately be placed over the cans permitting the ice to seek its own location.

The shoulder strap 23 is sown to the exterior of the front and rear width portions 35 and 37 of the receptacle 13, and, has an adjustment buckle for adjusting the length of the strap 23.

The multi-purpose exterior pockets 25 and 27 are sown to the front width portion 35 and the side 29, respectively. Pocket 27 includes a flap 26 which is closable as with Velcro fasteners 28. Velcro hook material is sown to the inner portion of the flap 26 which overlaps the outer pocket surface of the pocket 27 where Velcro loop material is sown for mateable engagement.

In the preferred embodiment, a removable, is fitted to be insertable into the cooler 11 and to rest on the base 33 forming a rigid bottom upon which the lowest layer of cans 15 may rest. The insert 43 includes lip portions 45 and 47 which assist in containing the lowest layer of cans each other, five abreast in the preferred embodiment, and permitting stacking of subsequent layers in pyramid fashion of the balance of a 15-pak of cans 15. Preferably, the lip portions 45 and 47 extend about mid-way up the interior of the front and rear width portions in order to support the pyramid stacking of the cans; and, strap portions (not shown) extend interiorly from the lip portions 45 and 47 to join the sown ends of the shoulder strap 23.

It is therefore to be understood that the following claims are intended to cover all of the generic and specific features of the present invention herein described, and all statements the scope of the invention which as a matter of language, might be said to fall there between.

Now that the invention has been described,

What is claimed is:

1. An improved portable cooler designed to transport, chill, and permit easy access to sealed beverages, said improved portable cooler comprising:

a receptacle for receiving sealed containers and coolant, said receptacle having a closed end and a sealable open end, said receptacle having a diminishing cross-sectional length from said closed end to said open end and a substantially constant cross-sectional width, said diminishing cross-sectional length being sized to support stacked layers of diminishing numbers of containers in relatively stable, side-wise parallel relation, said substantially constant cross-sectional width being sized and proportioned to accommodate a given length of container plus coolant alongside top and bottom of the containers, said receptacle comprising a soft, expandable, insulated material suitable for insulating sealed beverages and substantially containing icy liquid coolant;

a lid, said lid being sized and disposed for mateable engagement with said sealable open end; and, an insert, said insert being sized and disposed for insertion through said sealable open end and for mateable engagement with said closed end, said insert including upwardly extending lip portions and being further sized and disposed to accommodate a first row of a pre-designated number of containers in parallel, said upwardly extending lip portions maintaining said pre-designated number of containers in parallel relation.

2. An improved portable cooler as in claim 1, said improved portable cooler including a strap means, said strap means engaging said receptacle.

3. An improved portable cooler as in claim 1, said improved portable cooler including at least one pocket, said one pocket being disposed about said receptacle.

4. An improved portable cooler as in claim 1, said portable cooler comprising an expandable, insulated material, such as neoprene, with a non-slip surface suitable for insulating sealed beverages, for substantially containing icy water, and for reducing heat transfer away from said sealed beverages.

5. An improved portable cooler designed to transport, chill, and permit easy access to sealed beverages, said improved comprising a receptacle for receiving sealed containers and coolant, said receptacle having a closed end and a sealable open end, said receptacle having a diminishing cross-sectional length from said closed end to said open end and a substantially constant cross-sectional width, said diminishing cross-sectional length being sized to support stacked layers of diminishing numbers of containers in substantially stable, side-wise parallel relation, said substantially constant cross-sectional width being sized and proportioned to accommodate a given length of container, said receptacle including webbing extending from said closed end towards said sealable open end, said webbing being sized and proportioned to receive coolant in various forms and to maintain coolant in substantially adjacent relation to said sealed containers, said receptacle comprising a soft, expandable, insulated material suitable for insulating sealed beverages and substantially containing icy water;

a lid, said lid being sized and disposed for mateable engagement with said sealable open end;

an insert, said insert being sized and disposed for insertion through said sealable open end and for mateable engagement with said closed end, said insert including upwardly extending lip portions and being further sized and disposed to accommodate a first row of a pre-designated number of containers in parallel, said upwardly extending lip portions maintaining said pre-designated number of containers in parallel relation;

a strap means, said strap means engaging said receptacle; and, at least one pocket, said one pocket being disposed about said receptacle.

6. An improved portable cooler as in claim 5, said improved portable cooler including:

lid fastening means for fastening said lid to said sealable open end.

7. An improved portable cooler as in claim 6, said lid including:

an attached end and an attachable end, said attachable end being substantially opposite said attached end, said attachable end including a first portion of Velcro material, said attached end being attached to said receptacle, said sealable open end including a second portion of Velcro material, and, said lid fastening means comprising said first and second portions of Velcro material, said first and second portions of Velcro material being sized and proportioned for mateable engagement.

8. An improved portable cooler as in claim 5, said lid comprising a soft, expandable, insulated material suitable for insulating sealed beverages and substantially containing icy water.

9. An improved portable cooler as in claim 5, said strap means being adjustable by a user.

10. An improved portable cooler as in claim 5, at least one of said pockets having a sealable open pocket end and a flap.

11. An improved portable cooler as in claim 10, said at least one of said pockets including a pocket fastening means for securing said flap in closed position over said sealable open pocket end.

12. An improved portable cooler as in claim 11, said flap including a flap portion of Velcro material, said sealable open pocket end including a pocket portion of Velcro material, said pocket fastening means comprising said flap and pocket portions of Velcro material, said flap and pocket portions of Velcro material being sized and proportioned for mateable engagement.

* * * * *